US006626771B2

(12) United States Patent
Watanabe

(10) Patent No.: US 6,626,771 B2
(45) **Date of Patent: *Sep. 30, 2003**

(54) GOLF BALL

(75) Inventor: Hideo Watanabe, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/853,750

(22) Filed: May 14, 2001

(65) Prior Publication Data

US 2002/0002087 A1 Jan. 3, 2002

(30) Foreign Application Priority Data

May 15, 2000 (JP) ..... 2000-141540

(51) Int. Cl.[7] ..... A63B 37/04; A63B 37/06; A63B 37/12; A63B 37/14; A63B 37/00

(52) U.S. Cl. ..... 473/371; 473/378; 473/351

(58) Field of Search ..... 473/351, 354, 473/355, 356, 357, 358, 359, 360, 361, 362, 363, 364, 365, 367, 368, 369, 370, 371, 372, 373, 374, 375, 376, 377, 378, 383, 385

(56) References Cited

U.S. PATENT DOCUMENTS 5,605,968 A * 2/1997 Egashira et al. ..... 473/367
5,752,889 A * 5/1998 Yamagishi et al. .. 273/DIG. 20
5,779,563 A * 7/1998 Yamagishi et al. ..... 473/371
5,782,707 A * 7/1998 Yamagishi et al. ..... 473/373
5,803,834 A * 9/1998 Yamagishi et al. ..... 473/372
5,820,492 A * 10/1998 Yamagishi et al. ..... 473/372
5,823,888 A * 10/1998 Maruko et al. ..... 273/DIG. 20
5,846,141 A 12/1998 Morgan et al.
5,863,264 A * 1/1999 Yamagishi et al. .. 273/DIG. 20
5,911,639 A * 6/1999 Kasashima et al. ..... 473/377
5,967,908 A * 10/1999 Yamagishi et al. ..... 473/373
6,039,660 A * 3/2000 Kasashima et al. ..... 473/378
6,053,820 A * 4/2000 Kasashima et al. ..... 473/378
6,210,292 B1 * 4/2001 Higuchi et al. ..... 473/374

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

A golf ball satisfies the following conditions (1) to (6): (1) the number of dimples is 360 to 492; (2) total volume enclosed by the dimples as expressed as a percentage of the volume of the golf ball, $V_R$, is 0.715% to 0.825%; (3) the total surface area of the dimples as expressed as a percentage of the surface area of the golf ball, $S_R$, is not less than 70%; (4) the cover has a Shore D hardness of 53 to 63; (5) the difference obtained through subtraction of JIS C hardness of the surface portion of the core from JIS C hardness of the cover is 0 to 20; and (6) initial velocity is in excess of 77.7 m/s (255 ft/s).

7 Claims, 2 Drawing Sheets

GOLF BALL

BACKGROUND OF THE INVENTION

1. Field of the Invention

The present invention relates to a golf ball enabling a golfer who has a rather low club head speed to drive the ball a long distance.

2. Description of the Related Art

U.S. Pat. No. 5,846,141 discloses a golf ball having an initial velocity in excess of 255 feet/s (77.7 m/s) when tested under the conditions set forth in the Royal and Ancient Golf Club of St. Andrews (R&A) and the United States Golf Association (USGA) and traveling less than 296.8 yards (271.4 m) in carry and run when tested under the conditions set forth in R&A and USGA.

The golf ball described in U.S. Pat. No. 5,846,141 has a core and a cover and an initial velocity in excess of 255 feet/s (77.7 m/s) when tested under the conditions set forth in the applicable rule established by USGA, and travels less than 296.8 yards in carry and run when tested under the conditions set forth in the applicable rule. According to the publication, since the golf ball has an initial velocity in excess of that prescribed by R&A and USGA, the golf ball enables a golfer who has a rather low club head speed to drive the ball a long distance.

However, U.S. Pat. No. 5,846,141 does not specifically disclose how the initial velocity of the golf ball is increased, and those skilled in the art have encountered difficulty in embodying a golf ball having an increased initial velocity from the publication.

SUMMARY OF THE INVENTION

In view of the foregoing, it is an object of the present invention to provide a golf ball having an increased initial velocity implemented through specification of conditions with respect to dimples, core hardness, and cover hardness, among others, to thereby enable a golfer who has a rather low club head speed to drive the ball a long distance.

To achieve the above object, the present invention provides a golf ball comprising a core and a cover, the golf ball satisfying the following conditions (1) to (6):

(1) the number of dimples is 360 to 492;

(2) total volume enclosed by the dimples as expressed as a percentage of the volume of the golf ball, $V_R$, is 0.715% to 0.825%;

(3) total surface area of the dimples as expressed as a percentage of the surface area of the golf ball, $S_R$, is not less than 70%;

(4) the cover has a Shore D hardness of 53 to 63;

(5) a difference obtained through subtraction of JIS C hardness of a surface portion of the core from JIS C hardness of the cover is 0 to 20; and (6) initial velocity is in excess of 77.7 m/s (255 ft/s).

In the present invention, the total volume enclosed by dimples as expressed as a percentage of the volume of the golf ball, $V_R$, the total surface area of dimples as expressed as a percentage of the surface area of the golf ball, $S_R$, and the initial velocity are expressed as follows:

[$V_R$]

$V_R$(%) is expressed as below.

[Expression 1]

$$V_R = \frac{V_S}{\frac{4}{3}\pi R^3} \times 100$$

(where $V_S$ is total space volume of dimples, each having a dimple space volume $V_P$, and R is the radius of the golf ball (an imaginary sphere). The dimple space volume $V_P$ is defined as the volume of a space enclosed by a dimple surface and a plane surrounded by an edge of the dimple.)

$V_S$ appearing above in Exp. 1 is expressed below by Exp. 2. $V_S$ obtained from Exp. 2 is substituted into Exp. 1 to thereby obtain $V_R$.

[Expression 2]

$$V_S = N_1 V_{P1} + N_2 V_{P2} + \ldots + N_n V_{Pn} = \sum_{i=1}^{n} N_i V_{Pi}$$

(where $V_{P1}, V_{P2}, \ldots, V_{Pn}$ each represent the volume of a dimple, the dimples being of different shapes. $N_1, N_2, \ldots, N_n$ each represent the number of dimples having the respective one of volumes $V_{P1}, V_{P2}, \ldots, V_{Pn}$. n is an integer equal to or greater than 1.)

A method for obtaining the dimple space volume $V_P$ will next be described with respect to a dimple having a circular shape as viewed from above. Referring to FIG. 1, an imaginary spherical surface 5 having the diameter of the ball is formed on a dimple 4, and an imaginary spherical surface 6 having a diameter 0.16 mm smaller than the diameter of the ball is formed as well. A dimple edge 10 is defined as a collection of intersections 9, each of which is an intersection of the imaginary spherical surface 5 and a tangent 8 to the dimple 4 at an intersection 7 of the imaginary spherical surface 6 and the dimple 4. Since an edge portion of the dimple 4 is usually rounded, the dimple edge 10 is thus defined for clarity. Referring to FIGS. 2 and 3, the dimple space volume $V_P$ of a dimple space 12 is obtained on the basis of a plane (a circle having a diameter $D_m$) 11 surrounded by the dimple edge 10 and a distance (a dimple depth $D_P$) between the plane 11 and the bottom of the dimple space 12. When dimples of a single type are involved, the product of the dimple space volume $V_P$ and the number of dimples is obtained. When dimples of two or more types are involved, the product of the dimple space volume $V_P$ and the number of dimples is obtained for each type of dimples. The thus-obtained product(s) is used to obtain the total space volume of dimples $V_S$ according to Exp. 2. The thus-obtained $V_S$ is used to obtain the total volume enclosed by dimples as expressed as a percentage of the volume of a golf ball, $V_R$, according to Exp. 1.

[$S_R$]

$S_R$(%) is expressed as below. A dimple edge is defined as in the case of $V_R$ described above.

[Expression 3]

$$S_R = \frac{S_S}{4\pi R^2}$$

(where $S_S$ is total surface area of dimples, and R is the radius of a golf ball (an imaginary sphere). The surface area of a dimple is defined as the area of a dimple surface below the plane surrounded by the dimple edge.)

[Initial Velocity]

Initial velocity is measured on an initial velocity meter similar to a drum-rotation-type initial velocity meter approved by USGA. A ball is conditioned for a minimum of 3 hours at 23±1° C. and is then tested in a room conditioned to 23±2° C. The ball is struck by a club head (a striking mass) of approximately 250 lbs (113.4 kg) at a striker velocity of 143.8 ft/s (43.83 m/s). A dozen balls are struck four times each. Time required to pass through a distance of 6.28 ft (1.88 mm) is measured to thereby calculate initial velocity. The cycle is completed in approximately 15 minutes.

Other and further objects, features and advantages of the present invention will be more apparent from the following description.

DESCRIPTION OF THE INVENTION AND PREFERRED EMBODIMENTS

Figure 1:
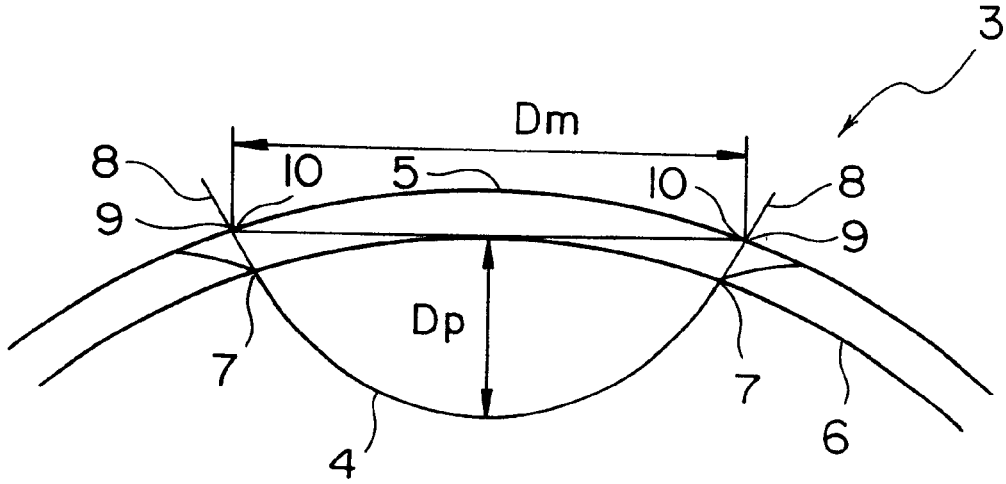
FIG. 1 is a view showing a method for obtaining a dimple space volume.
Figure 2:
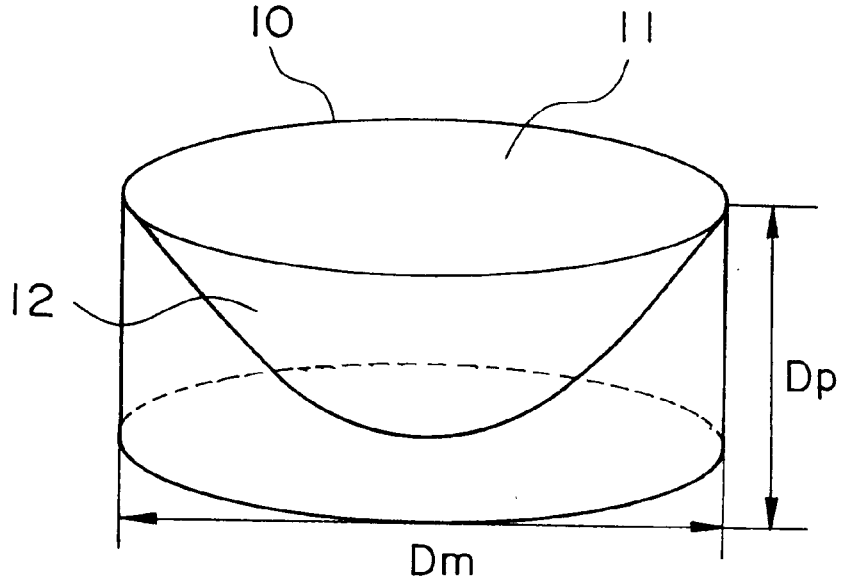
FIG. 2 is a view showing a method for obtaining a dimple space volume.
Figure 3:
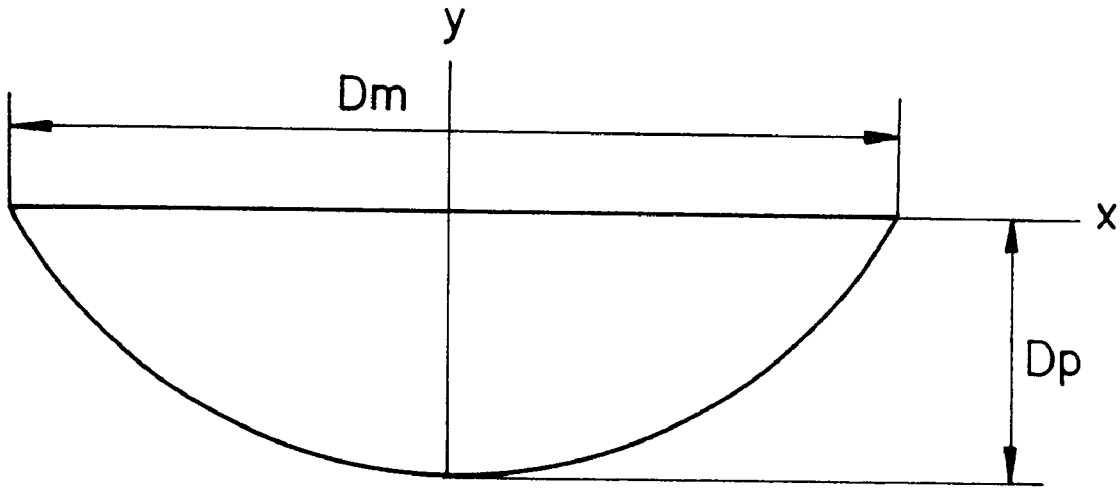
FIG. 3 is a view showing a method for obtaining a dimple space volume.

The present invention will next be described in detail. A golf ball of the present invention has 360 to 492 dimples. When the number of dimples is less than 360, optimum lift cannot be obtained, resulting in a decrease in travel distance. When the number of dimples is in excess of 492, trajectory lowers, with a resultant failure to yield sufficient travel distance. A preferred range of the number of dimples is 380 to 460.

A golf ball of the present invention has a $V_R$ of 0.715% to 0.825%. When $V_R$ is less than 0.715%, the ball pops up with a resultant decrease in travel distance. When $V_R$ is in excess of 0.825%, trajectory becomes too low, resulting in an excessive decrease in carry. A preferred range of $V_R$ is 0.73% to 0.80%.

The golf ball of the present invention has an $S_R$ not less than 70%. When $S_R$ is less than 70%, the optimum lift-to-drag ratio is not obtained, with a resultant failure to yield sufficient travel distance. A more preferred range of $S_R$ is 72% to 80%.

The golf ball of the present invention has a cover of Shore D hardness 53 to 63. When the Shore D hardness of the cover is less than 53, the initial velocity of the ball sometimes falls within the range prescribed by R&A and USGA, with the result that a sufficiently high initial velocity cannot be obtained. When the Shore D hardness of the cover is in excess of 63, the cover becomes too hard, potentially resulting in excessively impaired durability of the ball against cracking. A preferred range of a Shore D hardness of the cover is 58 to 63.

The golf ball of the present invention has a difference of 0 to 20 after subtraction of JIS C hardness of a surface portion of a core from JIS C hardness of a cover. When the difference is less than 0, the golfer's feeling at impact becomes too hard, or the ball fails to achieve an initial velocity in excess of that prescribed by R&A and USGA. When the difference is in excess of 20, the golfer's feeling at impact becomes too soft, and the durability of the ball against cracking is impaired. A preferred range of the difference is 4 to 16.

The golf ball of the present invention has an initial velocity in excess of 77.7 m/s (255 ft/s) when tested under the conditions set forth in R&A and USGA. When the initial velocity is not higher than 77.7 m/s, the ball travels merely a distance over which a conventional ball travels. A preferred range of initial velocity is 78.0 m/s or higher.

Next, layer components of the golf ball of the present invention will be described. A core material is not particularly limited. For example, vulcanized rubber containing a predominant amount of polybutadiene rubber, polyisoprene rubber, natural rubber, or silicone rubber can be used. However, vulcanized rubber containing a predominant amount of polybutadiene rubber is particularly preferred.

The golf ball of the present invention can be manufactured by the steps of adding pentachlorothiophenol or a metallic salt of pentachlorothiophenol to a core material to thereby form a core having high initial velocity; and covering the core with a relatively hard cover (for example, a cover having a Shore D hardness of 60 or higher). In this manner, a golf ball having an initial velocity in excess of 77.7 m/s can be yielded easily. Pentachlorothiophenol or a metallic salt of pentachlorothiophenol is preferably a zinc salt of pentachlorothiophenol; for example, Renacit IV (product of Bayer Corp.).

A core may assume a single-layer structure formed of a single material or a multilayer structure composed of two or more layers of different materials. In the case of a multilayer core, "JIS C hardness of a surface portion of a core" appearing previously means the hardness of a surface portion of the outermost layer of the core. The outermost layer of the core is preferably made of a rubber material similar to that which a center is made of.

A cover material of the golf ball of the present invention is not particularly limited. For example, the cover may be made of an ionomer resin or a mixture of a predominant amount of an ionomer resin and a polyester resin, a polyurethane resin, a polyamide resin, or a polyolefin resin. Particularly, ionomer resins such as those commercially available from Du Pont, Ltd. under the trade name Surlyn and from Du Pont Mitsui Polychemicals Co., Ltd. under the trade name Himilan are preferred.

The thickness of a cover is not greater than 2.5 mm, preferably 1.2 mm to 2.3 mm. When the cover is too thick, a golfer's feeling at impact becomes too hard, or the ball fails to achieve an initial velocity in excess of that prescribed by R&A and USGA. When the cover is too thin, the durability of the ball against cracking is impaired, or the spin rate increases when struck with a driver, with a resultant failure to yield sufficient travel distance.

The thus-obtained golf ball may be finished through application of coating to the surface and stamping the surface with marking as needed. The hardness of the ball as represented by the amount of deformation under a load of 100 kg is preferably 2.0 mm to 3.5 mm, more preferably 2.3 mm to 3.0 mm. The ball can be formed in such a manner as to have a diameter not less than 42.67 mm and a weight not greater than 45.93 g under the Rules of Golf as approved by R&A.

EXAMPLES

The present invention will next be described with reference to examples, which are not to be construed as limiting the invention.

Examples and Comparative Examples

Solid cores for golf balls of Examples 1 to 16 and Comparative Examples 1 to 4 and 6 to 10 were formed by the steps of: kneading corresponding rubber compositions for core use shown in Tables 1 to 5; and vulcanizing the resultant rubber materials for approximately 15 minutes at a temperature of 155° C. in corresponding core molds. In Tables 1 to 5, peroxide (1) is dicumyl peroxide commercially available from NOF Corp. under the trade name Percumyl D; peroxide (2) is 1,1-bis(t-butyl peroxy)3,3,5-trimethylcyclohexane commercially available from NOF Corp. under the trade name Perhexa 3M-40; antioxidant is that commercially available from Ouchi Shinko Chemical Industry Co., Ltd. under the trade name Nocrac NS-6; and zinc salt of pentachlorothiophenol is that commercially available from Bayer Corp. under the trade name Renacit IV.

The thus-obtained cores were covered with corresponding cover materials shown in Table 6 through injection molding, followed by normal coating to thereby manufacture golf balls of Examples 1 to 16 and Comparative Examples 1 to 4 and 6 to 10. A golf ball of Comparative Example 5 was a golf ball commercially available from Sumitomo Rubber Industries, Ltd. under the trade name DDH TourSpecial.

In Tables 1 to 5, $S_R$ and $V_R$ of a golf ball were calculated according to the expressions mentioned previously, and the initial velocity of a golf ball and that of a core were measured by the method described previously.

The golf balls were tested for flight characteristics, durability against cracking, and feeling at impact by the following methods. Test results are shown in Tables 1 to 5.

Flight Characteristics

A golf ball was struck at a club head speed of 45 m/s by use of a driver (W #1) mounted on a swing robot, to thereby measure a launch angle, a travel distance, and a spin rate. A maximum angle from horizontal that a struck ball reached was measured by means of a camera positioned in parallel with a tee at a height of 1.6 m, and was defined as the launch angle. The driver used for the test was Tour Stage X100 (product of Bridgestone Sports Corp.; 10° loft angle). A travel distance was evaluated as follows through comparison with that achieved by the golf ball DDH TourSpecial (Comparative Example 5) from Sumitomo Rubber Industries, Ltd.

○: A total distance is a distance achieved by DDH TourSpecial+1 m or more.

Δ: A total distance is a distance achieved by DDH Tour Special+less than 1 m.

X: A total distance is a distance achieved by DDH Tour Special−1 m or less.

Durability Against Cracking

A golf ball was repeatedly struck at a club head speed of 40 m/s by use of a driver (W #1; 10° loft angle), to thereby measure the number of strikes at which the ball began to crack). Durability against cracking was evaluated under the following criteria. Notably, a ball was struck at a random point. Six balls each of Examples 1 to 16 and Comparative Examples 1 to 4 and 6 to 10 were tested.

○: 180 or more strikes at which a ball began to crack.

X: 150 or less strikes at which a ball began to crack.

Feeling

Three professional golfers struck the golf balls using a driver and evaluated their feelings about impact under the following criteria.

○: Good

Δ: Slightly soft

X: Too hard

TABLE 1

| | | Example 1 | Example 2 | Example 3 | Example 4 | Example 5 | Example 6 |
|---|---|---|---|---|---|---|---|
| Number of dimples | | 432 | 432 | 392 | 420 | 392 | 392 |
| $S_R$(%) | | 75.5 | 75.5 | 74.7 | 78.1 | 75.1 | 75.1 |
| $V_R$(%) | | 0.779 | 0.779 | 0.754 | 0.752 | 0.736 | 0.779 |
| Cover Material | | a | a | a | a | a | a |
| Shore D Hardness of Cover | | 63 | 63 | 63 | 63 | 63 | 63 |
| Ball | Diameter (mm) | 42.7 | 42.7 | 42.7 | 42.7 | 42.7 | 42.7 |
| | Weight (g) | 45.5 | 45.5 | 45.5 | 45.5 | 45.5 | 45.5 |
| | Initial Velocity (m/s) | 78.2 | 78.1 | 78.1 | 78.1 | 78.1 | 78.1 |
| Core | Diameter (mm) | 38.5 | 38.5 | 38.5 | 38.5 | 38.5 | 38.5 |
| | Weight (g) | 35.1 | 35.0 | 35.0 | 35.0 | 35.0 | 35.0 |
| | Initial Velocity (m/s) | 78.1 | 77.9 | 77.9 | 77.9 | 77.9 | 77.9 |
| Difference in Hardness between Cover and Core | JIS C Hardness of Cover: X | 92 | 92 | 92 | 92 | 92 | 92 |
| | JIS C Hardness of Core Surface: Y | 84 | 81 | 81 | 81 | 81 | 81 |
| | X-Y | 8 | 11 | 11 | 11 | 11 | 11 |
| Core Material | Polybutadiene | 100 | 100 | 100 | 100 | 100 | 100 |
| | Isoprene rubber | — | — | — | — | — | — |
| | Zinc acrylate | 33.5 | 30.4 | 30.4 | 30.4 | 30.4 | 30.4 |
| | Peroxide (1) | 0.6 | 0.6 | 0.6 | 0.6 | 0.6 | 0.6 |
| | Peroxide (2) | 0.6 | 0.6 | 0.6 | 0.6 | 0.6 | 0.6 |
| | Antioxidant | 0.1 | 0.1 | 0.1 | 0.1 | 0.1 | 0.1 |
| | Barium sulfate | — | — | — | — | — | — |
| | Zinc oxide | 18.8 | 20.1 | 20.1 | 20.1 | 20.1 | 20.1 |
| | Zinc salt of pentachlorothiophenol | 1 | 1 | 1 | 1 | 1 | 1 |
| Flight | Launch angle (°) | 9.2 | 9.1 | 9.1 | 9.2 | 9.2 | 8.9 |
| | Carry (m) | 217.7 | 214.2 | 214.6 | 214.4 | 214.5 | 212.7 |
| | Total Distance (m) | 232.4 | 232.3 | 232.5 | 232.1 | 232.7 | 230.2 |
| | Spin (rpm) | 2415 | 2318 | 2318 | 2318 | 2318 | 2318 |
| | Evaluation of Distance | ○ | ○ | ○ | ○ | ○ | ○ |

TABLE 1-continued

| | Example 1 | Example 2 | Example 3 | Example 4 | Example 5 | Example 6 |
|---|---|---|---|---|---|---|
| Durability against Cracking | ○ | ○ | ○ | ○ | ○ | ○ |
| Feeling | ○ | ○ | ○ | ○ | ○ | ○ |

Peroxide (1): Dicumyl peroxide - Percumyl D (NOF Corp.)
Peroxide (2): 1,1-bis(t-butyl peroxide)3,3,5-trimethylcyclohexane - Perhexa 3M-40 (NOF Corp.)
Antioxidant: Nocrac NS-6 (Ouchi Shinko Chemical Industry Co., Ltd.)
Zinc salt of pentachlorothiophenol: Renacit IV (Bayer Corp.)

TABLE 2

| | | Example 7 | Example 8 | Example 9 | Example 10 | Example 11 | Example 12 |
|---|---|---|---|---|---|---|---|
| Number of dimples | | 432 | 432 | 432 | 432 | 432 | 432 |
| $S_R$(%) | | 75.5 | 75.5 | 75.5 | 75.5 | 75.5 | 75.5 |
| $V_R$(%) | | 0.779 | 0.779 | 0.779 | 0.779 | 0.779 | 0.779 |
| Cover Material | | a | a | a | a | a | a |
| Shore D Hardness of Cover | | 63 | 63 | 63 | 63 | 63 | 63 |
| Ball | Diameter (mm) | 42.7 | 42.7 | 42.7 | 42.7 | 42.7 | 42.7 |
| | Weight (g) | 45.4 | 45.4 | 45.4 | 45.4 | 45.4 | 45.4 |
| | Initial Velocity (m/s) | 78.0 | 78.2 | 78.1 | 78.1 | 78.2 | 78.0 |
| Core | Diameter (mm) | 38.5 | 38.9 | 38.9 | 38.9 | 39.3 | 39.2 |
| | Weight (g) | 35.1 | 35.8 | 35.9 | 35.8 | 36.7 | 36.7 |
| | Initial Velocity (m/s) | 77.8 | 78.1 | 77.9 | 77.6 | 78.1 | 77.9 |
| Difference in Hardness between Cover and Core | JIS C Hardness of Cover: X | 92 | 92 | 92 | 92 | 92 | 92 |
| | JIS C Hardness of Core Surface: Y | 77 | 83 | 80 | 76 | 84 | 80 |
| | X-Y | 15 | 9 | 12 | 16 | 8 | 12 |
| Core Material | Polybutadiene | 100 | 100 | 100 | 100 | 100 | 100 |
| | Isoprene rubber | — | — | — | — | — | — |
| | Zinc acrylate | 27.4 | 33.5 | 30.4 | 27.4 | 33.5 | 30.4 |
| | Peroxide (1) | 0.6 | 0.6 | 0.6 | 0.6 | 0.6 | 0.6 |
| | Peroxide (2) | 0.6 | 0.6 | 0.6 | 0.6 | 0.6 | 0.6 |
| | Antioxidant | 0.1 | 0.1 | 0.1 | 0.1 | 0.1 | 0.1 |
| | Barium sulfate | — | — | — | — | — | — |
| | Zinc oxide | 21.3 | 17.7 | 19.0 | 20.2 | 16.3 | 17.6 |
| | Zinc salt of pentachlorothiophenol | 1 | 1 | 1 | 1 | 1 | 1 |
| Flight | Launch angle (°) | 9.0 | 9.2 | 9.1 | 9.0 | 9.3 | 9.1 |
| | Carry (m) | 211.2 | 216.1 | 214.2 | 212.8 | 217.8 | 216.5 |
| | Total Distance (m) | 230.8 | 234.4 | 232.1 | 231.3 | 237.3 | 234.5 |
| | Spin (rpm) | 2258 | 2506 | 2355 | 2323 | 2332 | 2250 |
| | Evaluation of Distance | ○ | ○ | ○ | ○ | ○ | ○ |
| Durability against Cracking | | ○ | ○ | ○ | ○ | ○ | ○ |
| Feeling | | ○ | ○ | ○ | ○ | ○ | ○ |

TABLE 3

| | | Example 13 | Example 14 | Example 15 | Example 16 |
|---|---|---|---|---|---|
| Number of dimples | | 432 | 432 | 432 | 432 |
| $S_R$(%) | | 75.5 | 75.5 | 75.5 | 75.5 |
| $V_R$(%) | | 0.779 | 0.779 | 0.779 | 0.779 |
| Cover Material | | b | b | b | a |
| Shore D Hardness of Cover | | 60 | 60 | 60 | 63 |
| Ball | Diameter (mm) | 42.7 | 42.7 | 42.7 | 42.7 |
| | Weight (g) | 45.2 | 45.1 | 45.1 | 45.3 |
| | Initial Velocity (m/s) | 77.8 | 77.8 | 77.8 | 78.1 |
| Core | Diameter (mm) | 38.5 | 38.9 | 39.3 | 37.9 |
| | Weight (g) | 35.1 | 35.8 | 36.7 | 33.5 |
| | Initial Velocity (m/s) | 78.1 | 78.1 | 78.1 | 78.1 |
| Difference in Hardness between Cover and Core | JIS C Hardness of Cover: X | 88 | 88 | 88 | 92 |
| | JIS C Hardness of Core Surface: Y | 84 | 83 | 84 | 84 |
| | X–Y | 4 | 5 | 4 | 8 |
| Core | Polybutadiene | 100 | 100 | 100 | 100 |

TABLE 3-continued

| | | Example 13 | Example 14 | Example 15 | Example 16 |
|---|---|---|---|---|---|
| Material | Isoprene rubber | — | — | — | — |
| | Zinc acrylate | 33.5 | 33.5 | 33.5 | 33.5 |
| | Peroxide (1) | 0.6 | 0.6 | 0.6 | 0.6 |
| | Peroxide (2) | 0.6 | 0.6 | 0.6 | 0.6 |
| | Antioxidant | 0.1 | 0.1 | 0.1 | 0.1 |
| | Barium sulfate | — | — | — | — |
| | Zinc oxide | 18.8 | 17.7 | 16.3 | 18.8 |
| | Zinc salt of pentachlorothiophenol | 1 | 1 | 1 | 1 |
| Flight | Launch angle (°) | 9.3 | 9.3 | 9.4 | 9.2 |
| | Carry (m) | 215.8 | 216.7 | 216.7 | 216.5 |
| | Total Distance (m) | 231.7 | 233.6 | 232.9 | 232.0 |
| | Spin (rpm) | 2560 | 2534 | 2526 | 2431 |
| | Evaluation of Distance | ○ | ○ | ○ | ○ |
| Durability against Cracking | | ○ | ○ | ○ | ○ |
| Feeling | | ○ | ○ | ○ | ○ |

TABLE 4

| | | Compara. Ex. 1 | Compara. Ex. 2 | Compara. Ex. 3 | Compara. Ex. 4 | Compara. Ex. 5 |
|---|---|---|---|---|---|---|
| Number of dimples | | 392 | 392 | 500 | 336 | 432 |
| $S_R$(%) | | 75.2 | 74.7 | 70.0 | 58.7 | 78.7 |
| $V_R$(%) | | 0.830 | 0.710 | 0.794 | 0.797 | 0.755 |
| Cover Material | | a | a | a | a | — |
| Shore D Hardness of Cover | | 63 | 63 | 63 | 63 | — |
| Ball | Diameter (mm) | 42.7 | 42.7 | 42.7 | 42.7 | 42.7 |
| | Weight (g) | 45.5 | 45.5 | 45.5 | 45.5 | 45.4 |
| | Initial Velocity (m/s) | 78.1 | 78.1 | 78.1 | 78.1 | 77.0 |
| Core | Diameter (mm) | 38.5 | 38.5 | 38.5 | 38.5 | — |
| | Weight (g) | 35.0 | 35.0 | 35.0 | 35.0 | — |
| | Initial Velocity (m/s) | 77.9 | 77.9 | 77.9 | 77.9 | — |
| Difference in Hardness between Cover and Core | JIS C Hardness of Cover: X | 92 | 92 | 92 | 92 | — |
| | JIS C Hardness of Core Surface: Y | 81 | 81 | 81 | 81 | — |
| | X–Y | 11 | 11 | 11 | 11 | — |
| Core Material | Polybutadiene | 100 | 100 | 100 | 100 | — |
| | Isoprene rubber | — | — | — | — | — |
| | Zinc acrylate | 30.4 | 30.4 | 30.4 | 30.4 | — |
| | Peroxide (1) | 0.6 | 0.6 | 0.6 | 0.6 | — |
| | Peroxide (2) | 0.6 | 0.6 | 0.6 | 0.6 | — |
| | Antioxidant | 0.1 | 0.1 | 0.1 | 0.1 | — |
| | Barium sulfate | — | — | — | — | — |
| | Zinc oxide | 20.1 | 20.1 | 20.1 | 20.1 | — |
| | Zinc salt of pentachlorothiophenol | 1 | 1 | 1 | 1 | — |
| Flight | Launch angle (°) | 8.6 | 9.4 | 8.8 | 8.9 | 9.0 |
| | Carry (m) | 208.5 | 211.5 | 212.2 | 209.4 | 212.3 |
| | Total Distance (m) | 228.3 | 227.0 | 228.1 | 224.2 | 229.0 |
| | Spin (rpm) | 2318 | 2318 | 2318 | 2318 | 2454 |
| | Evaluation of Distance | Δ | x | Δ | x | — |
| Durability against Cracking | | ○ | ○ | ○ | ○ | ○ |
| Feeling | | ○ | ○ | ○ | ○ | ○ |

TABLE 5

| | Compara. Ex. 6 | Compara. Ex. 7 | Compara. Ex. 8 | Compara. Ex. 9 | Compara. Ex. 10 |
|---|---|---|---|---|---|
| Number of dimples | 432 | 432 | 432 | 432 | 432 |
| $S_R$(%) | 75.5 | 75.5 | 75.5 | 75.5 | 75.5 |
| $V_R$(%) | 0.779 | 0.779 | 0.779 | 0.779 | 0.779 |
| Cover Material | a | c | d | a | e |
| Shore D Hardness of Cover | 63 | 50 | 59 | 63 | 65 |

TABLE 5-continued

| | | Compara. Ex. 6 | Compara. Ex. 7 | Compara. Ex. 8 | Compara. Ex. 9 | Compara. Ex. 10 |
|---|---|---|---|---|---|---|
| Ball | Diameter (mm) | 42.7 | 42.7 | 42.7 | 42.7 | 42.7 |
| | Weight (g) | 45.2 | 45.5 | 45.5 | 45.4 | 45.4 |
| | Initial Velocity (m/s) | 77.1 | 76.8 | 77.9 | 77.8 | 78.2 |
| Core | Diameter (mm) | 38.5 | 38.5 | 38.5 | 38.9 | 39.2 |
| | Weight (g) | 34.7 | 35.0 | 35.1 | 35.8 | 36.5 |
| | Initial Velocity (m/s) | 77.2 | 77.9 | 78.3 | 77.2 | 77.6 |
| Difference in Hardness between Cover and Core | JIS C Hardness of Cover: X | 92 | 74 | 86 | 92 | 96 |
| | JIS C Hardness of Core Surface: Y | 80 | 81 | 87 | 71 | 77 |
| | X–Y | 12 | −7 | −1 | 21 | 19 |
| Core Material | Polybutadiene | 95 | 100 | 100 | 100 | 100 |
| | Isoprene rubber | 5 | — | — | — | — |
| | Zinc acrylate | 25.0 | 30.4 | 35.8 | 23.8 | 27.4 |
| | Peroxide (1) | 0.65 | 0.6 | 0.6 | 0.6 | 0.6 |
| | Peroxide (2) | 0.6 | 0.6 | 0.6 | 0.6 | 0.6 |
| | Antioxidant | — | 0.1 | 0.1 | 0.1 | 0.1 |
| | Barium sulfate | 16.9 | — | — | — | — |
| | Zinc oxide | 5.0 | 20.1 | 19.0 | 20.4 | 18.9 |
| | Zinc salt of pentachlorothiophenol | — | 1 | 1 | 1 | 1 |
| Flight | Launch angle (°) | 9.0 | 9.4 | 9.4 | 8.9 | 9.1 |
| | Carry (m) | 210.2 | 209.5 | 216.2 | 210.8 | 212.5 |
| | Total Distance (m) | 227.9 | 225.9 | 232.5 | 227.1 | 233.2 |
| | Spin (rpm) | 2314 | 2495 | 2648 | 2026 | 2265 |
| | Evaluation of Distance | x | x | ○ | x | ○ |
| Durability against Cracking | | ○ | ○ | ○ | x | x |
| Feeling | | ○ | ○ | x | Δ | ○ |

TABLE 6

| Cover Material (Unit: Parts by Weight) | a | b | c | d | e |
|---|---|---|---|---|---|
| Himilan 1706 | 50 | — | — | — | — |
| Himilan 1557 | — | 50 | 20 | 50 | — |
| Himilan 1855 | — | — | 30 | — | — |
| AM7317 | — | — | — | — | 50 |
| Himilan 1605 | 50 | — | — | — | — |
| Himilan 1601 | — | 50 | — | 45 | — |
| Surlyn 8120 | — | — | 30 | 5 | — |
| AM7318 | — | — | — | — | 50 |
| Nucrel AN4311 | — | — | 20 | — | — |
| Titanium Oxide | 5 | 5 | 5 | — | 5 |
| Shore D Hardness | 63 | 60 | 50 | 59 | 65 |
| JIS C Hardness | 92 | 88 | 74 | 86 | 66 |

Himilan: Trade name of an ionomer resin from Du Pont Mitsui Polychemicals Co., Ltd.
Surlyn: Trade name of an ionomer resin from Du Pont, Ltd.
AM7317, AM7318: Trade names of high-rigidity ionomer resins from Du Pont Mitsui Polychemicals Co., Ltd.
Nucrel AN4311: Trade name of a ternary copolymer of ethylene, methacrylic acid, and acrylic ester from Du Pont Mitsui Polychemicals Co., Ltd.

As seen from Tables 1 to 5, the golf balls of the present invention have an initial velocity in excess of that prescribed by R&A and USGA through specification of conditions with respect to dimples, core hardness, and cover hardness, among others, to thereby enable a golfer who has a rather low club head speed to drive the ball a long distance. The golf balls of the present invention are also satisfactory with respect to durability against cracking and feeling at impact.

By contrast, the golf balls of Comparative Examples involve the following drawbacks.

Comparative Example 1: Due to high $V_R$, lift is insufficient with a resultant decrease in travel distance.

Comparative Example 2: Due to low $V_R$, the ball pops up with a resultant decrease in travel distance.

Comparative Example 3: Due to a large number of dimples, the launch angle is small. Thus, the ball lands in a shorter distance than a ball of the present invention.

Comparative Example 4: Due to a small number of dimples and low $S_R$, the optimum lift-to-drag ratio is not obtained, with a resultant failure to yield sufficient travel distance.

Comparative Example 5: Due to low initial velocity, the ball lands in a shorter distance than a ball of the present invention.

Comparative Example 6: Since the core material does not contain a zinc salt of pentachlorothiophenol, initial velocity becomes low. Thus, the ball lands in a shorter distance than a ball of the present invention.

Comparative Example 7: Since the cover is soft, and the difference in hardness "X–Y" between the cover and the core is less than 0, initial velocity becomes low. Thus, the ball lands in a shorter distance than a ball of the present invention.

Comparative Example 8: Since the cover is hard, and the difference in hardness "X–Y" between the cover and the core is less than 0, the core becomes substantially hard. Thus, feeling at impact becomes too hard.

Comparative Example 9: Since the difference in hardness "X–Y" between the cover and the core is in excess of 20, the core becomes substantially soft, a travel distance decreases, and feeling at impact becomes soft. Also, durability against cracking is impaired.

Comparative Example 10: Since the cover is too hard, durability against cracking is poor.

What is claimed is:

1. A golf ball comprising a core and a cover, said golf ball satisfying the following conditions (1) to (6):

(1) the number of dimples is 360 to 492;

(2) total volume enclosed by the dimples as expressed as a percentage of the volume of said golf ball, $V_R$, is 0.715% to 0.825%, wherein $V_R$ is expressed as below;

$$V_R = \frac{V_S}{\frac{4}{3}\pi R^3} \times 100$$

wherein $V_S$ is total space volume of dimples, each having a dimple space volume $V_P$, and R is the radius of the golf ball (an imaginary sphere) and a dimple space volume $V_P$ is defined as the volume of a space enclosed by a dimple surface and a plane surrounded by an edge of the dimple;

(3) total surface area of the dimples as expressed as a percentage of the surface area of said golf ball, $S_R$, is not less than 70%, wherein $S_R$ is expressed as below;

$$S_R = \frac{S_S}{4\pi R^2}$$

wherein $S_S$ is total surface area of dimples, and R is the radius of a golf ball (an imaginary sphere) and surface area of a dimple is defined as the area of a dimple surface below the plane surrounded by the dimple edge;

(4) said cover has a Shore D hardness of 53 to 63;

(5) a difference obtained through subtraction of JIS C hardness of a surface portion of said core from JIS C hardness of said cover is 4 to 16; and (6) initial velocity is in excess of 77.7 m/s (255 ft/s).

2. A golf ball as defined in claim 1, wherein the number of dimples is 380 to 460.

3. A golf ball as defined in claim 1, wherein the total volume enclosed by the dimples as expressed as a percentage of the volume of said golf ball, $V_R$, is 0.73% to 0.80%.

4. A golf ball as defined in claim 1, wherein the total surface area of the dimples as expressed as a percentage of the surface area of said golf ball, $S_R$, is 72% to 80%.

5. A golf ball as defined in claim 1, wherein the cover has a Shore D hardness of 58 to 63.

6. A golf ball as defined in claim 1, wherein the initial velocity is in excess of 78.0 m/s.

7. A golf ball as defined in claim 1, wherein a core material contains pentachlorothiophenol or a metallic salt of pentachlorothiophenol.

* * * * *